United States Patent [19]

Zernig

[11] 3,977,043

[45] Aug. 31, 1976

[54] FURNITURE HINGE

[76] Inventor: Ernst Zernig, Muhlenweg 29, 587 Hemer, Germany

[22] Filed: May 17, 1974

[21] Appl. No.: 471,112

[30] Foreign Application Priority Data

May 17, 1973 Germany ..... 2325057

[52] U.S. Cl. ..... 16/137; 16/149; 16/163; 16/171

[51] Int. Cl.[2] ..... E05D 11/00

[58] Field of Search ..... 16/163, 164, 149, 128 R, 16/171, 137, DIG. 13, DIG. 40

[56] References Cited

UNITED STATES PATENTS

| | | | |
|---|---|---|---|
| 1,196,580 | 8/1916 | Pelot | 16/149 |
| 1,341,063 | 5/1920 | McQueen | 16/128 R |
| 2,243,065 | 5/1941 | Barrett | 16/149 X |
| 2,735,133 | 2/1956 | Hey et al. | 16/128 R |
| 3,731,343 | 5/1973 | Naske | 16/163 |
| 3,805,323 | 4/1974 | Fukui | 16/128 R |

FOREIGN PATENTS OR APPLICATIONS

| | | | |
|---|---|---|---|
| 812,521 | 9/1951 | Germany | 16/149 |
| 2,036,565 | 7/1970 | Germany | 16/137 |
| 6,503,272 | 10/1965 | Netherlands | 16/128 R |
| 1,136,003 | 12/1968 | United Kingdom | 16/171 |

*Primary Examiner*—George H. Krizmanich
*Attorney, Agent, or Firm*—Pollock, Vande Sande & Priddy

[57] ABSTRACT

A hinge comprising a securing cylinder which is adapted to be embedded in a mating bore in a door or wall and also a connecting block fitting into a recess provided in said securing cylinder. A screw secures the connecting block to the securing cylinder, and in response thereto the outer periphery of the connecting block is urged tightly against the walls which define the mating bore. A hinge arm is pivotally connected to said connecting block.

8 Claims, 20 Drawing Figures

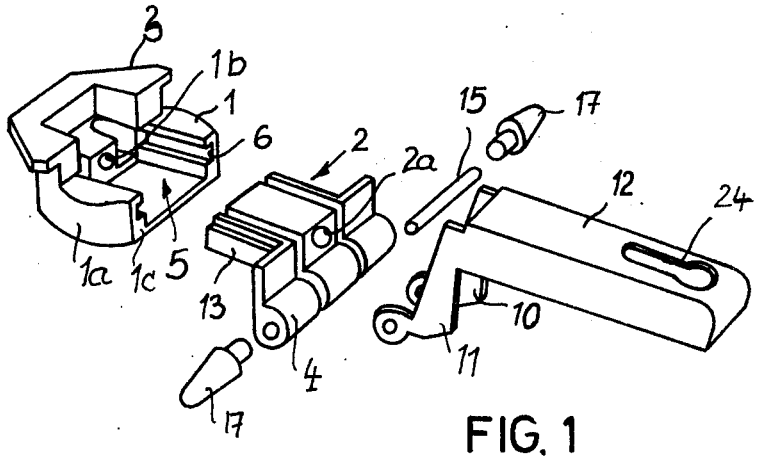
FIG. 1
FIG. 1E
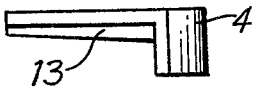
FIG. 1a
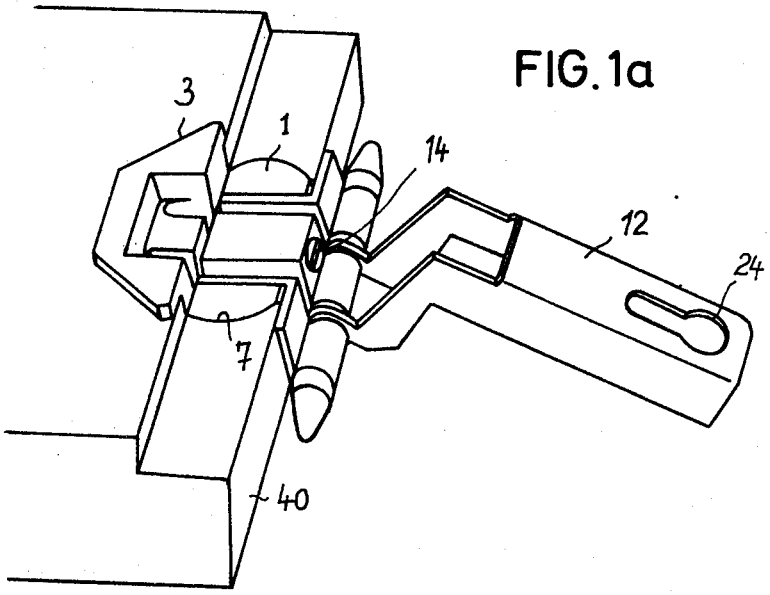

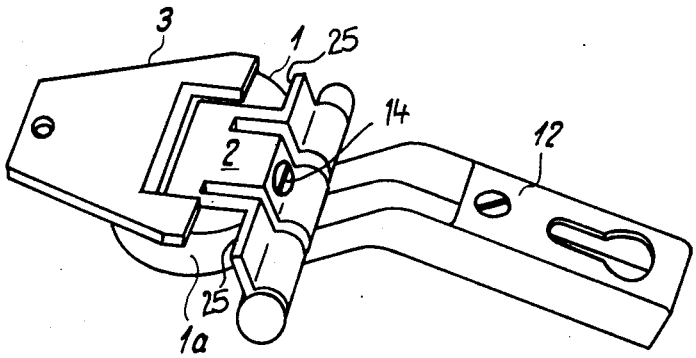
FIG. 1b
FIG. 1c
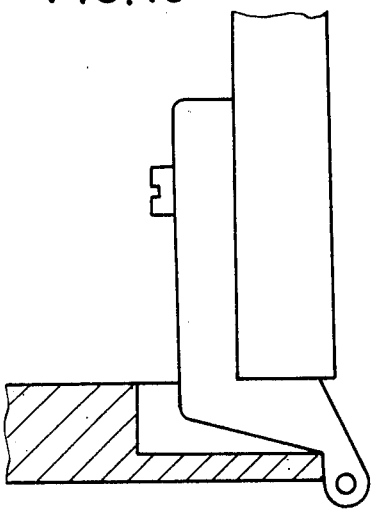
FIG. 1d
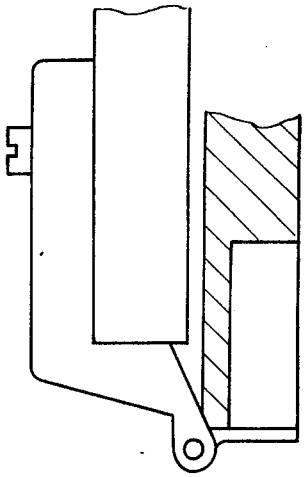

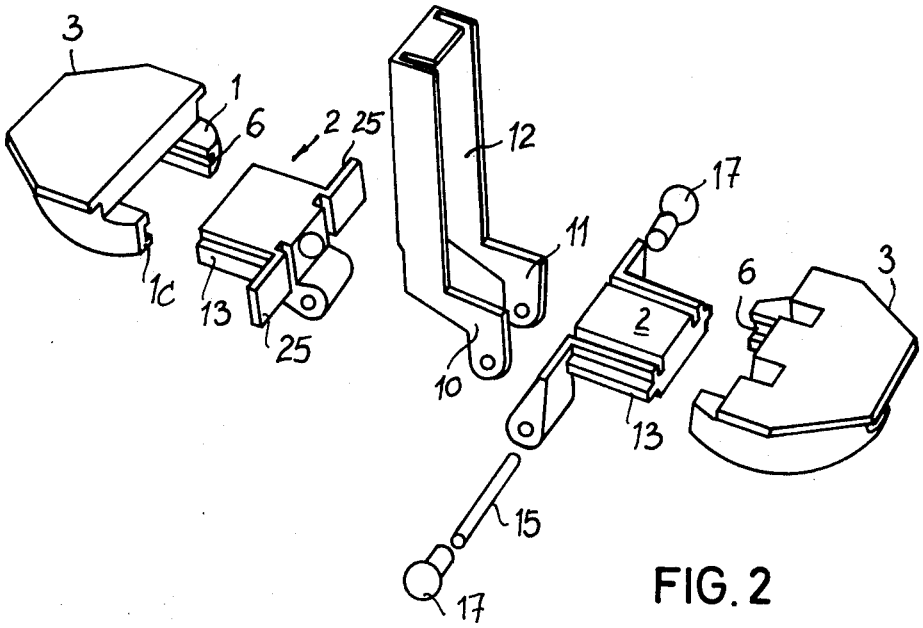
FIG. 2
FIG. 2a
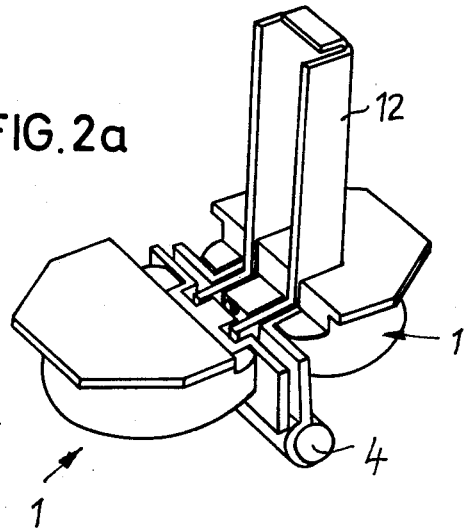

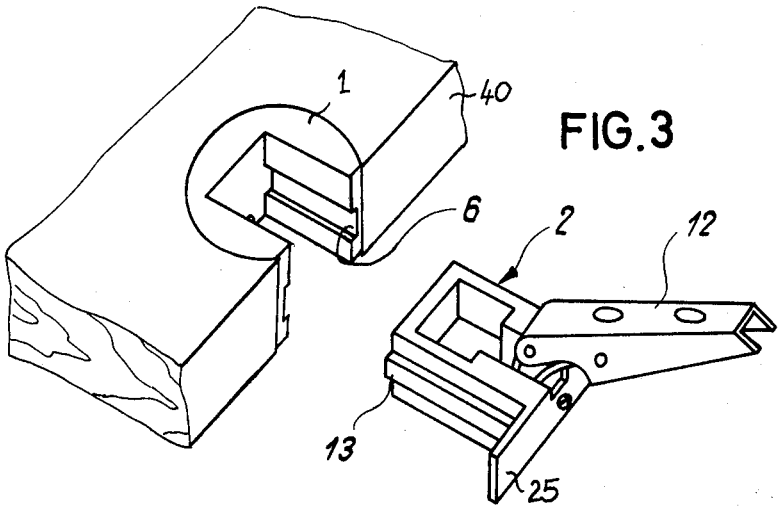
FIG. 3
FIG. 3a
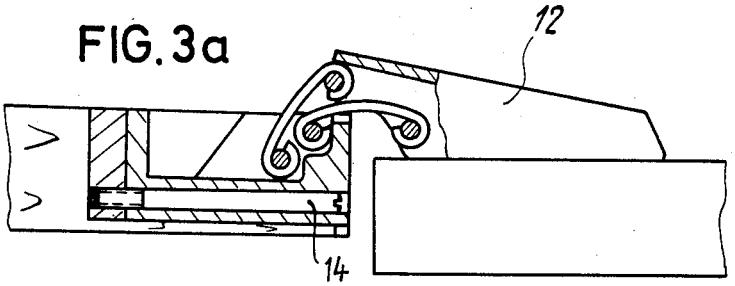
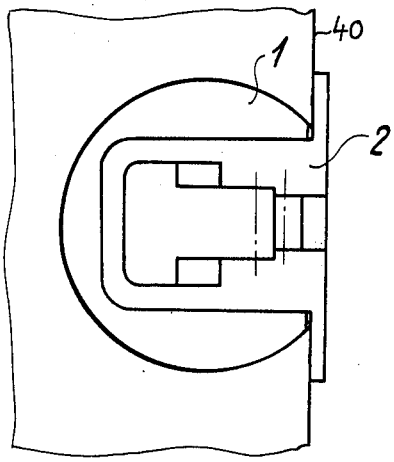
FIG. 3b

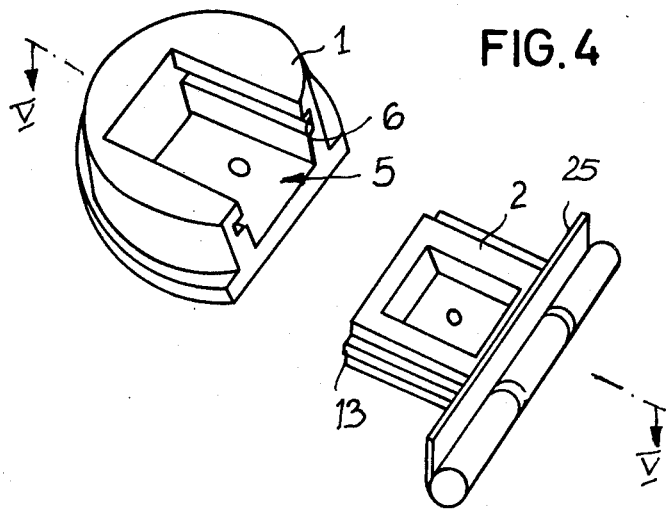
FIG. 4
FIG. 5
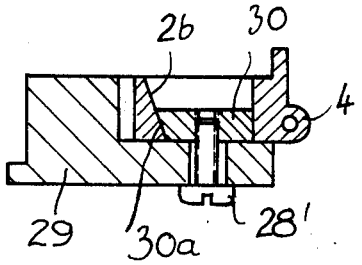

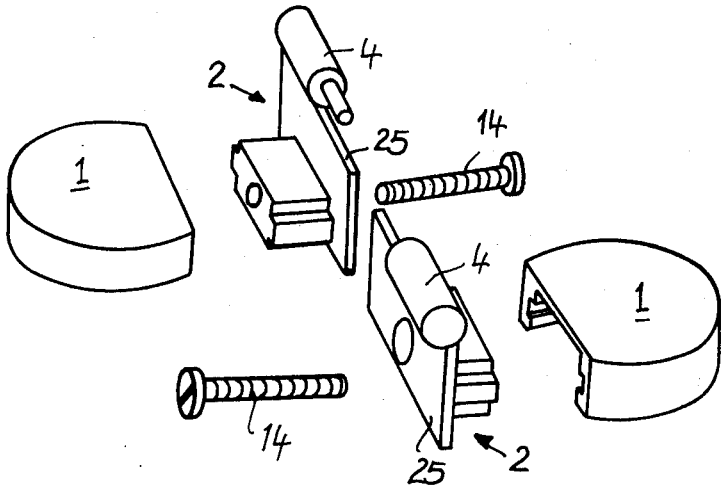
FIG.6
FIG.6a
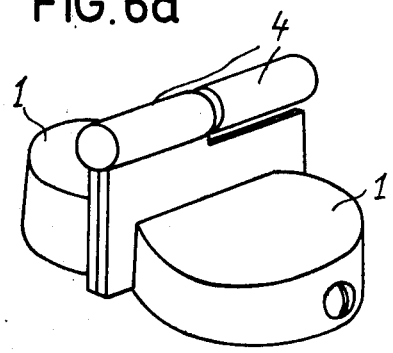

FIG. 6c
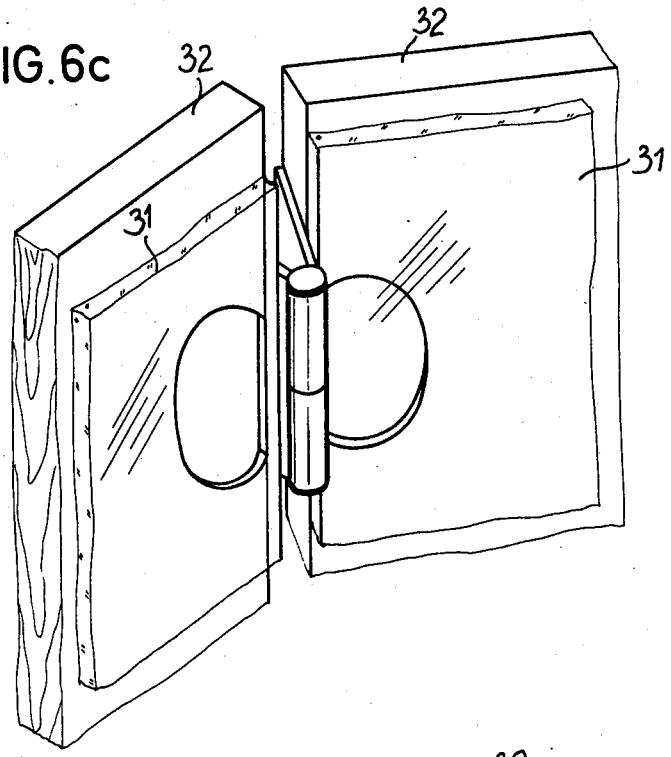
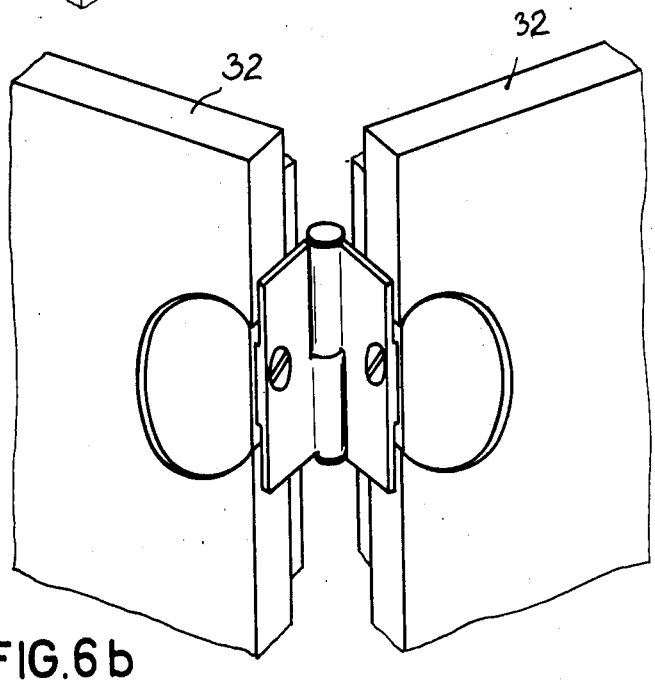
FIG. 6b

FURNITURE HINGE

The invention concerns a furniture hinge having a securing cylinder embedded in the door or wall of the furniture into which a connecting block carrying one part of the pivot joint can be fitted, and the other part of the pivot joint is carried by the component which is affixed to the appropriate other furniture part, whereby the connecting block and the cylinder can be screwed together.

The most common furniture hinges today consist of a securing cylinder embedded in a bore and screwed to one part of the furniture, together with a jointed arm connected to an adjusting plate which is screwed to the opposing furniture part. The cylinder is screwed into the bore by means of screws into the furniture wall.

It is also known to connect the jointed arm to a connecting block and to fit this connecting block in the securing cylinder whereby once again the cylinder is screwed to the furniture part.

All the known solutions are disadvantageous in that the strain between the securing cylinder and the furniture part is taken by the screws. This is especially a disadvantage when the material which is to receive the screws is thin.

The object of the invention is to provide a furniture hinge of the type mentioned, so constructed that the strain between the furniture part and the securing cylinder can be taken by a clamping arrangement between the cylinder, connecting block and furniture part, so that additional securing screws are unnecessary.

This object is achieved according to the invention by forming the connecting block with abutment surfaces, shaped to contact the end surface of the furniture wall or door, so that the surfaces abut when the connecting screw is tightened, and the embedded cylinder is pressed against the side of the bore, thereby becoming firmly clamped.

In a prefered embodiment, the securing cylinder and the connecting block have corresponding guide means, whereby the connecting screw is arranged parallel to the guide means. With such an embodiment, assembly of the parts is substantially simplified.

The invention suggests further that the connecting screw is arranged to penetrate the securing cylinder and bore a pointed end into the side of the bore hole. This arrangement prevents the cylinder from rotating within the circular bore.

With the invention it is possible to use metal for the heavily loaded joints and at the same time to provide a hinge cylinder securing means suitable for production assembly. Furthermore it is possible with a new hinge, quickly and easily to modify a given type of hinge, for example a single-pivot or multi-pivot hinge with securing cylinders of different diameters and dimensions as desired. The many variations made thus possible, simplify store-keeping for both the manufacturer and the fitters, and widen the range of possible uses.

The advantages of the invention are also especially apparent in connection with period furniture. Whereas it has until now not been possible to use hinges with a securing cylinder, this can now be done. Despite the new securing means, the aesthetical impression of the period furniture hinge is externally not disturbed because the actual securing elements are always on the inside of the doors and furniture, and therefore not visible. Further characteristics and advantages of the invention are disclosed in the discription, the drawings and the sub-claims.

In the following, preferred embodiments of the invention are discribed in detail with the aid of the drawings.

FIG. 1 is a perspective exploded view of the parts of a single pivot hinge for folding doors with the main parts; securing cylinder, connecting block, and hinge arm.

FIG. 1*a* illustrates the hinge shown in FIG. 1 in assembled condition

FIG. 1*b* is a perspective view of a normal single-pivot hinge

FIGS. 1*c* and 1*d* show sections through the fitted hinge of FIG. 1*b* in open and closed conditions.

FIG. 1*e* is a top view of the connecting block showing the taper on rib 13.

FIG. 2 shows a perspective exploded view of the parts of a two-door single-pivot hinge for folding doors, having two connecting blocks pivoted to a single hinge arm.

FIG. 2*a* is a perspective view of the hinge in FIG. 2 in assembled condition.

FIGS. 2*b* and 2*c* show sections through the fitted hinge of FIG. 2 in closed and opened condition.

FIG. 2*d* is a simplified sectional view of the securing cylinder arrangement of the two-door hinge according to FIG. 2.

FIG. 3 is a perspective view of cylinder and connecting block with hinge arm, for hinge with four pivots.

FIG. 3*a* is a sectional view through a fitted hinge with 4 pivots according to FIG. 3.

FIG. 3*b* is a plan view of a securing cylinder with connecting block inserted and hinge arm removed.

FIG. 4 is an exploded view of another type of hinge.

FIG. 5 is a section through the assembled hinge of FIG. 4 in the plane V - V FIG. 6 is a perspective exploded view of the parts of an example of a variation in which both furniture parts to be hinged are provided with securing cylinders.

Figure 2B:
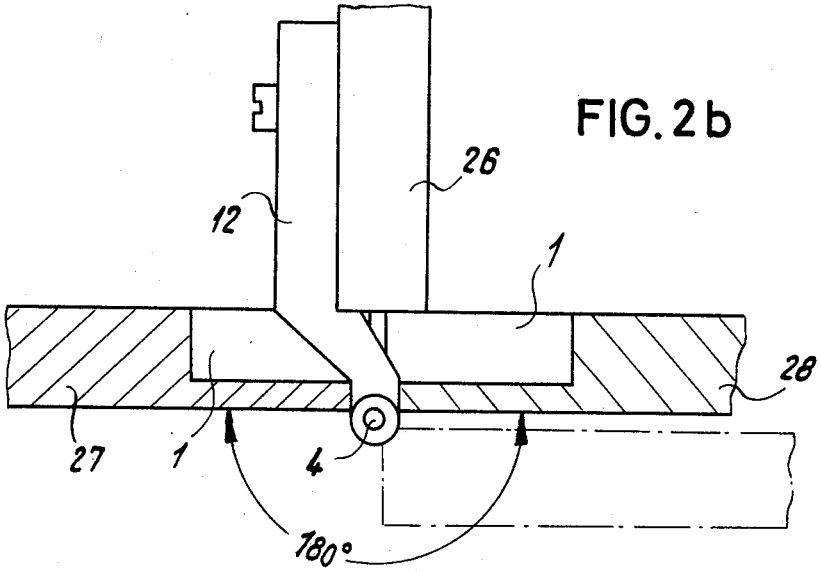

FIG. 6*a* is a perspective view of a hinge according to FIG. 6 in assembled condition. FIGS. 6*b* and 6*c* are views showing possible uses of hinge according to FIG. 6, for example a folding mirror.

Referring to FIGS. 1 to *od*, a cylindrical securing part 1 has a flange 3. The embodiment according to FIGS. 1, 1*a*, 1*c* and 1*d* is of a type used for folding doors, and the flange 3 is accordingly offset and arranged a step higher than the securing cylinder. With the embodiment according to FIG. 1*b* the underside of the flange 3 is level with the upper side of the securing cylinder 1. The securing cylinder 1 has a receiving space 5 and guide slots or channels 6 into which corresponding ribs 13 of the connecting block 2 are inserted. Whereas the guide channels 6 are parallel to each other, the ribs, or the side parts of the connecting block 2 upon which the ribs are situated are tapered in such a manner that the width at the rear end is less than the width at the front end which is the end nearer to the pivot bearing 4. The result of this is that when the connecting block 2 is pushed into the receiving space 5, the securing cylinder is spread apart so that the side walls 1*a* are pressed firmly against the side of the bore 7. This spreading apart is possible because of the elastic properties of the securing cylinder 1. The connecting block 2 is secured to the cylinder 1 with the aid of a screw 14 which is passed through a hole 2*a* in the connection block 2 and into a screw hole 1*b* in the securing cylinder. The screw 14 may, if desired, be so arranged that it will also screw into the wall of the bore which receives the cylinder. The pivot arms 10 and 11 of the hinge arm 12 are jointed by means of the pin 15 to the pivot bearing 4. In a well known but not depicted manner the hinge arm 12 is fitted to a base plate which is not shown and held by a screw through the hole 24. The base plate is secured to the second furniture part and the securing cylinder 1 is affixed to the first furniture part. Cover plugs 17 are inserted into the pivot bearings at each end.

The connecting block 2 may be formed of metal and the securing cylinder of plastic.

The embodiment according to FIG. 1*b* represents in general the construction of the above described embodiment and has similar parts.

Figure 2D:
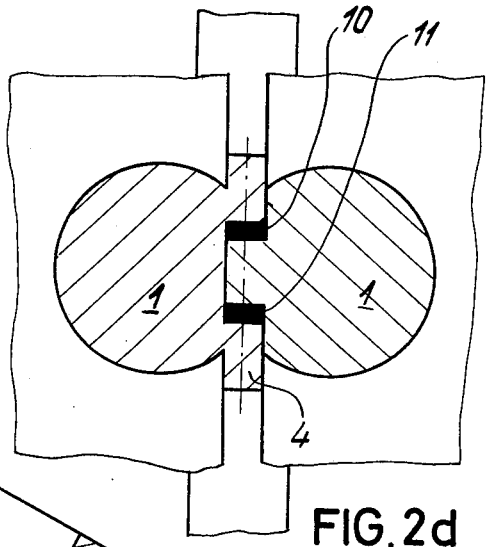

FIGS. 2 to 2*d* show a two-door single pivot hinge whereby two connecting blocks 2 are pivoted to a single hinge arm 12. This two-door single pivot type hinge is for folding doors. In the previously described manner, the guide channels 6 in the securing cylinder are parallel to each other, and the guide ribs 13 on the connecting block 2 are tapered in this embodiment too. When the connecting blocks are screwed to their respective securing cylinders, each cylinder is spread apart and the outer surface 1*a* pressed against the sides of the respective bores.

It is also possible to make not only the guide channels but also the guide ribs parallel to each other. The same clamping effect of the securing cylinder 1 in the bore 7 also occurs if, when the screw 14 is tightened and the abutment plates 25 are pressed against the end surface of the furniture part, instead of the securing cylinder front surfaces 1*c* making contact with the abutment plates 25, they are kept some distance apart.

Figure 2C:
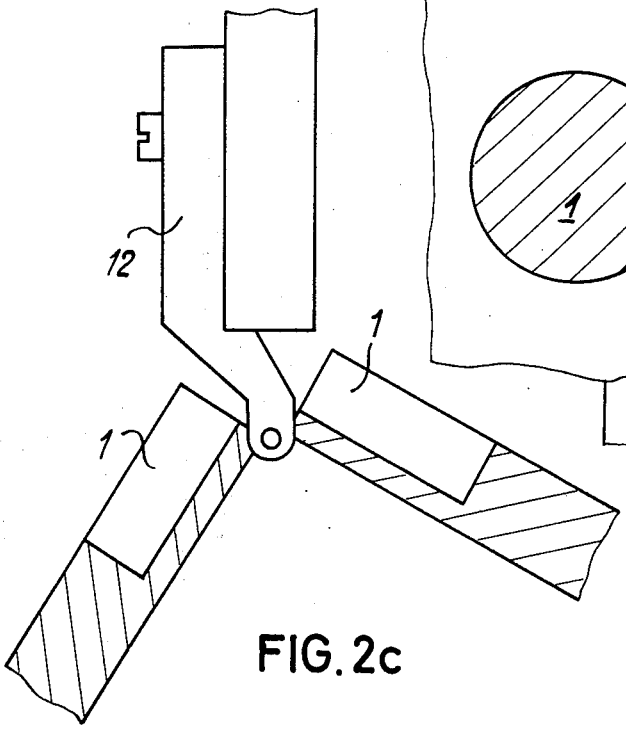

In FIGS. 2*b* to 2*d* the hinge arm 12 is affixed to a center wall 26 and the securing cylinders 1 are embedded each in a door 27 and 28.

FIGS. 3, 3*a* and 3*b* show the kind of connection between the securing cylinder and the connecting block already described on a hinge with four points of pivot. The use of a different type of hinge does not alter the means of securing the connecting block to the cylinder.

With the embodiment according to FIGS. 4 and 5 the connecting block 2 is clamped to the base 29 of the securing cylinder 1 by means of a square nut 30 together with a screw 28'. The square nut has an oblique surface 30 *a* which makes contact with the corresponding oblique surface 2*b* of the connecting block 2.

The FIGS. 6 and 6*a* show a further embodiment of the invention, namely a mirror hinge. The working principle remains unchanged, compared to the embodiments already described, merely the shape of the securing cylinder differs from those of the previous embodiments, and the position and form of the pivot bearings which are situated on the abutment plates 25 of the connecting block 2.

FIGS. 6*b* and 6*c* show examples of this hinge in use on a mirror. The mirror glass 31 is secured to a backing plate 32. In the example according to FIG. 6*c* the securing cylinder is fitted from the mirror side and is therefore not visible from the back. In the example according to FIG. 6*b* the securing cylinders are fitted from the rear of the backing plate 32 and can therefore be seen.

I claim:

1. A hinge for a door, wall, or the like comprising:

a securing member having at least a portion thereof which is of generally cylindrical configuration and adapted to be embedded in a mating bore formed in the plane of the door or wall and communicating with the hinged edge of the door or wall, a connecting block for pivotally supporting said hinge means, a recess in said securing member extending from an edge thereof radially inwardly for slidably receiving said connecting block, means for securing said connecting block to said securing member, and further means effective in response to the securing of said connecting block to said securing member to urge said securing member tightly against the walls of said mating bore.

2. A furniture hinge according to claim 1 characterized in that the connecting block is provided with slots for receiving, guiding and supporting bearing means on said hinge arm.

3. The hinge of claim 1 in which one of said securing member and said connecting block defines at least one protuberance and the other defines a mating slot for receiving said protuberance.

4. The hinge of claim 3 wherein one of said protuberance and slot is tapered to provide a tight fit as said securing member is slidably placed in said connecting block.

5. The furniture hinge of claim 1 in which said securing means comprises a nut having one oblique angled surface on one of its edges and an aperture in said securing member for said nut having a correspondingly angled sidewall, and a screw passing through respective aligned apertures in said connecting block and said securing member when said connecting block is fully inserted slidably in said securing member, said screw being normal to the direction of slidable insertion of said connecting block into said securing member, whereby abutment of the respective oblique surfaces on said nut and said aperture ensures proper relative positioning of said connecting block and said securing member.

6. The furniture hinge of claim 1 in which said securing means comprises a screw passing through said connecting block and said securing member and being screwed into the sidewall of said mating bore.

7. The furniture hinge of claim 1 in which said connecting block is provided with slots for receiving and pivotally supporting bearing arms on said hinge means.

8. The furniture hinge of claim 1 which further includes bearing means supported on said connecting block, said bearing means comprising a pivot for said hinge arm.

* * * * *